United States Patent [19]

Apelian et al.

[11] Patent Number: 5,062,943

[45] Date of Patent: Nov. 5, 1991

[54] MODIFICATION OF BIFUNCTIONAL CATALYST ACTIVITY IN HYDROPROCESSING

[75] Inventors: Minas R. Apelian, Vincetown, N.J.; Clinton R. Kennedy, West Chester, Pa.

[73] Assignee: Mobil Oil Corporation, Fairfax, Va.

[21] Appl. No.: 592,440

[22] Filed: Oct. 4, 1990

[51] Int. Cl.[5] ..... C10G 13/02

[52] U.S. Cl. ..... 208/59; 208/111; 208/49

[58] Field of Search ..... 208/111, 59

[56] References Cited

U.S. PATENT DOCUMENTS

| | | | |
|---|---|---|---|
| 2,953,519 | 9/1960 | Bercik | 208/143 |
| 2,954,339 | 9/1960 | Beavon | 208/216 |
| 3,227,646 | 1/1966 | Jacobson | 208/254 H |
| 3,244,617 | 4/1966 | Galbreath | 208/143 |
| 3,287,258 | 11/1966 | Mason | 208/143 |
| 3,291,722 | 12/1966 | Taylor | 208/143 |
| 3,368,965 | 2/1968 | Schuman | 208/143 |
| 3,423,307 | 1/1964 | McKinney | 208/213 |
| 3,524,807 | 8/1970 | Lewis, Jr. | 208/111 |
| 3,528,910 | 9/1970 | Haney | 208/216 |
| 3,657,110 | 4/1972 | Hengstebeck | 208/111 |
| 3,816,296 | 6/1974 | Hass et al. | 208/111 |
| 3,953,321 | 4/1976 | Ganster et al. | 208/216 |
| 4,098,721 | 7/1978 | Ganster | 252/434 |
| 4,149,965 | 4/1979 | Pine et al. | 208/216 R |
| 4,441,991 | 4/1984 | Dwyer et al. | 208/111 |
| 4,447,556 | 5/1984 | O'Hara et al. | 208/254 |
| 4,485,006 | 11/1984 | Biceroglu | 208/254 |
| 4,547,285 | 10/1985 | Miller | 208/89 |

FOREIGN PATENT DOCUMENTS 1429291 3/1976 United Kingdom .

OTHER PUBLICATIONS

Akzo Catalysts Symposium '88, 6-88, Kurhaus, The Netherlands, pp. 1-14, "Hydrocracking: Activity and Selectivity as a Function of Process Conditions and Catalysts Families".

*Primary Examiner*—Helane E. Myers
*Attorney, Agent, or Firm*—Alexander J. McKillop; Charles J. Speciale; Malcolm D. Keen

[57] ABSTRACT

The equilibration of a zeolitic hydrocracking catalyst is accelerated by the addition of nitrogen compounds to the hydrocracker feed during the start of cycle (SOC). Addition of the nitrogen compounds reduces the exotherm, indicative of a decrease in the hydrogenation activity of the catalyst consequent upon the addition of the nitrogen. The reduced hydrogenation level decreases hydrogen consumption at this point in the cycle so that units which are hydrogen constrained may be operated under more favorable conditions. In addition, the attainment of equilibrium or lineout conditions is accelerated and yield benefits, particularly in the production of middle distillates are observed.

17 Claims, No Drawings

MODIFICATION OF BIFUNCTIONAL CATALYST ACTIVITY IN HYDROPROCESSING

FIELD OF THE INVENTION

This invention relates to a method for controlling the activity of a bifunctional catalyst used in hydroprocessing operations such as hydrocracking, hydrotreating, hydrodemetallation and hydroisomerization.

BACKGROUND OF THE INVENTION

Hydroprocessing operations are widely used in the petroleum refining industry for a number of purposes. Hydrotreating and hydrofinishing process, for example, are generally used to reduce the impurity levels of petroleum oils, mostly by the removal of organic heteroatoms, especially sulfur and nitrogen, by their conversion to inorganic form permitting their removal from the oil. Hydrocracking is, of course, an established process in petroleum refining for the production of gasoline and distillate products from heavy oils and high boiling fractions from other processes including the refractory aromatic materials obtained from catalytic cracking. Hydrodemetallation used for reducing the metal content of oils, particularly reduced crudes and residual materials. The catalysts used in these processes are usually bifunctional materials which possess acidic functionality coupled with hydrogenation-dehydrogenation activity provided by a metal component which is usually selected from Group VIII of the Periodic Table, often combined with a Group VI metal in the case of Group VIII base metals, for example, in combinations such as Ni-W, Co-Mo, Ni-Mo. The acidic activity of the catalyst will vary according to the type of operation with hydrocracking catalysts using relatively acidic catalysts to achieve the required boiling range conversion which is desired. Hydrotreating, hydrofinishing and hydrodemetallation ctalysts, by contrast, may suffice with lower inherent acidities. The acidic activity is ususally provided by the porous support material for the metal component and for this purpose, oxide type materials are conventionally used, especially oxides such as alumina and silica-alumina.

The use of zeolite based hydrocracking catalysts is progressively increasing because of the higher activity and long term stability of these catalysts and for this purpose, large pour size zeolites such as zeolite X or the various forms of zeolite Y such as ultrastable zeolite Y (USY) are becoming conventional.

A notable advance in hydroprocessing technology is disclosed in U S. Pat. No. 4,419,220 (LaPierre) which discloses a process for hydroisomerizing paraffins using a catalyst based on zeolite beta. A related process is disclosed in EP 94827, in which zeolite beta is used as the catalyst for a hydrocracking operation which is capable of producing low pour point distillate products from high boiling feeds. Zeolite beta is believed to be unique in its capability of effecting a simultaneous reduction of pour point and boiling range by reason of its ability to selectively isomerize and convert paraffins in the presence of aromatics. Large pore size zeolites such as zeolites X and Y are aromatic-selective in contrast to zeolite beta's paraffin-selective behavior.

In hydroprocessing operations, hydrogen is consumed as a consequence of aromatics saturation, ring opening and cracking reactions as well as by removal of heteroatoms following ring opening. Hydrogen consumption tends to increase with conversion (defined as the increase in the amount of fractions boiling below a certain temperature, expressed as a weight percentage of the feed). During hydrocracking, the catalyst operates in two distinct phases during each hydrocracking cycle. Initially, the catalyst ages relatively rapidly from start of cycle (SOC) until lineout is obtained. Once lineout is attained, the catalyst is in relative equilibrium under a given set of feed constraints and reaction conditions and the rate of aging decreases materially until the end of cycle (EOC) is reached. During the start up phase, prior to attainment of lineout, reactor temperature is increased relatively rapidly, typically at a rate from 2° to 10° F./day, in order to maintain conversion relatively constant as the catalyst ages at its initial fast aging rate. After lineout is attained, the reactor operating temperature is increased at a rate of usually no more than 0.2° .F/day consequent upon the lower catalyst aging rate during this phase of the operation. Finally an end of cycle temperature is reached, at which the activity and/or selectivity of the catalyst has decreased to an unacceptable level and to this point reactivation or regeneration of the catalyst is carried out to restore activity and selectivity.

The activity of the catalyst in hydrocracking may be controlled by the presence of selective catalyst poisons in the feed which interact with the acidic sites on the bifunctional hydrocracking catalyst so as to reduce acidic activity while maintaining a relatively constant level in the hydrogenation function provided by the metal component of the catalyst. Processes in which nitrogenous compounds such as ammonia or organic amines are introduced into the hydrocracking zone together with the feed are disclosed, for example, in U.S. Pat. Nos. 3,524,807 (Lewis), 3,657,110 (Hengstebeck) and 3,186,296 (Hass). The effect of the nitrogen additions may vary according to the characteristics of the catalyst with certain highly siliceous catalysts being more resistant to the effects of nitrogen than others, as disclosed in U.S. Pat. No. 4,441,991 (Dwyer). GB 1 429 291 discloses a lube hydrocracking process in which various nitrogenous compounds may be added to the feed in order to maintain a relatively constant level of cracking activity as feeds with different nitrogen content are utilized in the process.

Hydrogen consumption is an important operating factor in a hydrocracking unit since hydrogen is relatively expensive to produce; unnecessary consumption should be minimized as far as possible. The hydrogenation reactions which take place during hydrocracking are characteristically exothermic and are therefore thermodynamically favored by lower temperatures. For this reason, hydrocracking is conventionally carried out at temperatures which do not usually exceed 850° F. at which point exothermic hydrogenation becomes thermodynamically less favored than endothermic cracking. At start up, however, relatively lower temperatures are employed because the catalyst is at its highest relative activity during this part of the cycle. These low temperatures are conducive to hydrogenation and accordingly the consumption of hydrogen during this part of the cycle is relatively high: the operation consumes more hydrogen for a given level of feed conversion, as compared to the consumption after lineout when the catalyst is essentially at equilibrium.

SUMMARY OF THE INVENTION

We have now found that the consumption of hydrogen during the start-up phase of the hydrocracking process, prior to lineout, may be reduced by the addition of nitrogen to the hydrocracking zone during this portion of the hydrocracking cycle. Once equilibrium has been obtained, and the catalyst reaches lineout conditions, the addition of the nitrogen compound may be terminated and the conversion and hydrogen consumption stabilized under lineout conditions. This start-up procedure is particularly useful for units which are hydrogen constrained and where the higher relative consumption of hydrogen during the start-up phase imposes limits on unit operation or an excessive load on the hydrogen plant. The use of the nitrogen compound has also been found to accelerate equilibration of the catalyst and reduces the time necessary to reach equilibrium, typically from about two months to about 20–30 days. This enables a further reduction of the hydrogen consumption to be achieved since the relative consumption during a relatively shorter start-up phase now becomes possible with the addition of the nitrogenous compound. Yield benefits for the production of middle distillate products may also be observed since the addition of the nitrogen reduces cracking and in processes using a zeolite beta based catalyst the level of isomerization is increased relative to the cracking so that a benefit in terms of the pour point of the distillate is also observed.

The method according to the present invention therefore comprises a technique for controlling the operation of a hydrocracking process in which a hydrocarbon fraction is contacted under hydrocracking conditions in the presence of hydrogen with a hydrocracking catalyst. The method comprises carrying out the initial phase of the hydrocracking cycle following start-of-cycle (SOC) during which the hydrocracking temperature is being raised at a first rate, in the presence of a nitrogen-containing organic compound to reduce the hydrogen consumption, followed by carrying out the hydrocracking during a second phase following the attainment of lineout during which the temperature of the hydrocracking is raised at a second rate which is lower than the first rate.

DETAILED DESCRIPTION

As described above, zeolite-based hydrocracking catalysts are becoming more commonly used because of their advantages, especially higher activity and long term stability. The zeolite catalysts used in hydrocracking are typically large pore size zeolites such as zeolites X and Y, especially USY. Other zeolites having large pore size structures may also be employed for example, ZSM-4 or ZSM-20. Zeolite beta may, as described below, also be employed. The large pore size zeolites may be accompanied by other zeolites especially the intermediate pore size zeolite such as ZSM-5.

The zeolite is usually composited with an active or inert binder such as alumiuna, silica or silica-alumina. Zeolite loadings of 20 to 90 weight percent are typical, usually at least about 50 percent zeolite e.g. 50–70 weight percent.

A metal hydrogenation component is also present as is conventional for hydrocracking catalysts. It may be a noble metal such as platinum or palladium or, more commonly, a base metal, usually from Groups VA, VIA or VIIIA of the IUPAC Periodic Table e.g. nickel, cobalt, molybdenum, vanadium, tungsten. Combinations of a Group VA or VIA metal or metals with a Group VIIIA metal are especially favored e.g. Ni-W, Co-Mo, Ni-V, Ni-Mo. Amounts of the metal are typically about 5–20% for the base metals and less e.g. 0.5% for the more active noble metals. The metal component may be incorporated by conventional methods such as ion exchange onto the zeolite or impregnation. Processing conditions are generally. conventional. Reactor inlet (feed) temperatures are typically from about 500° to 850° F. (about 260° to 455° C.), more usually about 650° to 850° F. (about 345° to 455° C.), with the possibility of being as low as about 575° F. (about 300° C.), hydrogen pressures typically of 400 to 4000 psig (about 2860 to 27680 kPa abs) with pressures of 800 to 2000 or 1000–2500 psig (5620 to 7000 or 7000–17340 kPa), circulation rates of 1000 to 4000 SCF/Bbl (about 180 to 720 n.1.1.$^{-1}$) and space velocities of 0.25 to 10, usually 0.5–2.0 hr.$^{-1}$ LHSV.

The nitrogenous compound which is added during the initial phase of the hydrocracking cycle may be cofed with the feedstock so that the feedstock and the nitrogenous compound contact the catalyst simultaneously during the reaction. When nitrogenous compound is co-fed with the feed, it may be added to the feedstock before it is fed into the hydrocracker unit or, alternatively, the nitrogenous compound may be metered separately into the unit, with due care being taken to ensure that the nitrogenous compound will be well distributed throughout the reactor in order to ensure that its effect is brought to bear upon all the catalyst. When the compound is to be employed for catalyst selectivity control, it will generally be preferred to add the nitrogenous compound to the feedstock prior to entry into the reactor because this will ensure good distribution of the nitrogen compound.

Nitrogenous Comoounds

The nitrogen-containing compounds which may be used in the present process should be ones which neither react with the charge material to a significant extent nor possess catalytic activity which would inhibit the desired reactions. The nitrogen-containing compounds may be gaseous, liquid or in the form of a solid dissolved in a suitable solvent such as toluene.

The nitrogenous compounds which are used include ammonia as well as basic, organic nitrogen-containing compounds including the alkyl amines, specifically the alkyl amines containing from 1 to 40 carbon atoms and preferably from 5 to 30 e.g. 5 to 10 carbon atoms such as alkyl diamines of from about 2 to 40 carbon atoms and preferably from 6 to 20 carbon atoms, aromatic amines from 6 to 40 carbon atoms such as aniline and heterocyclic nitrogen-containing compounds such as pyridine, pyrolidine, quinoline and the various isomeric benzoquinolines. If the compound contains substituents such as alkyl groups, these may themselves be substituted by other atoms or groups, for example, halo or hydroxyl groups as in ethanolamine and triethanolamine, for example.

An alternative is to use co-feeds which themselves contain nitrogen compounds which will have the desired effect on catalyst activity. Such co-feeds may be injected into the reactor at appropriate positions as described above and besides providing the desired operational control will participate in the hydrocracking themselves.

The amount of nitrogen-containing compound which is actually used will depend upon a number of factors including the composition of the feedstock, the extent to which it is desired to suppress catalytic activity and also upon the nature of the catalyst, particularly its acidity as represented by the silica:alumina ratio. Other constraining factors such as the desired operating temperature may also require the amount of the nitrogenous compound to be adjusted in order to obtain the desired results. Therefore, in any given situation, it is recommended that the exact amount to be used should be selected by suitable experiment prior to actual use. Because the reaction is reversible, the use of excessive amounts of the nitrogen-containing compound will not usually produce any undesirable and permanent effect on the catalyst although coking deactivation may occur. However, as a general guide, the amount of nitrogen-containing compound used will generally be in the range of 1 ppmw to 1.0 wt. percent, preferably 10 to 500 ppmw of the feedstock when used in steady state addition either for activity or selectivity control with its consequent effect on the steady state exotherm.

As mentioned above, cracking activity is favored by the more highly acidic zeolites and these are generally characterized by a relatively low silica:alumina ratio. Hence, acidic activity is related to the proportion of tetrahedral aluminum sites in the structure of the catalyst. The use of the nitrogenous compounds will be of greatest benefit with very clean feeds and with the more highly acidic forms of the zeolite, that is, with the forms which have the lower silica:alumina ratios. (The silica:alumina ratios referred to in this specification are the structural or framework ratios, as mentioned in U.S. Pat. No. 4,419,220, to which reference is made for an explanation of the significance of this together with a description of methods by which the silica:alumina ratio in the zeolite may be varied). Generally, the use of the nitrogen compounds will be preferred with the forms of zeolite beta which have silica:alumina ratios below about 100:1 and particularly, below 50:1, e.g. 30:1.

If zeolite beta is used as the acidic component of the catalyst, the hydrocracking is accompanied by isomerization of paraffinic components and depending upon the feedstock and the type of product which is to be produced, the conditions may be adjusted to favor either the isomerization or the hydrocracking reactions. Thus, if the objective is to dewax a feedstock while minimizing the bulk conversion, the process will be particularly useful with waxy distillate stocks such as kerosenes, jet fuels, lubricating oil stocks, heating oils and other distillate fractions whose pour point (ASTM D-97) needs to be maintained within certain limits. Lubricating oil stocks will generally boil above about 230° C. (about 445° C.) and more usually above about 315° C. (about 600° F.) and in most cases above about 345° C. (about 650° F.). Other distillate fractions will generally boil in the range 165° C. to 345° C. (about 330° to 650° F.). Feedstocks having an extended boiling range e.g. whole crudes, reduced crudes, gas oils and various high boiling stocks such as residual and other heavy oils may also be dewaxed by the present isomerization process although it should be understood that its principal utility will be with lubricating oil stocks and distillate stocks and light and heavy gas oils, as described in U.S. Pat. No. 4,419,220 to which reference is made for a more detailed description of the applicable feedstocks.

The nitrogen-containing compound is added to the hydrocracking zone, either by direct injection to the zone or by addition to the feed during the start-up period, prior to the time when the catalyst obtains equilibrium and achieves lineout. During this portion of the hydrocracking cycle, the reactor operating temperature is raised at a rate of from 1 to 20, usually 1.5° to 3.0 F. °/day as compared to the lower rate of temperature increase which is characteristic of lineout conditions where the temperature increase is typically 0.01 to 0.3, more usually 0.03 to F.°/day. Once lineout conditions have been achieved, addition of the nitrogen compound may be terminated or reduced to a lower level, depending upon the composition of the feed and the type of catalyst employed. With addition of the nitrogen during the start-up phase, a reduced temperature rise across the reactor is observed, indicative of decrease of the level of hydrogenation occurring within the reactor. This is shown in Figure of the drawings which shows the temperature profiles observed across three sequential hydrocracking reactors with a gas oil feed operating at 400 psig with varying levels of nitrogen addition (as tertiary-butylamine) added to the feed as a dopant. The reduced temperature gradient is readily apparent and the reduction in hydrogen consumption is particularly even with relatively low levels of nitrogen addition.

The following table shows the effect of ammonia on product yields and H2 consumption at 35 % conversion:

TABLE

| | Feed | | | | |
|---|---|---|---|---|---|
| Feed Nitrogen, ppmw | | 20 | 20 | 5 | 5 |
| Ammonia Level, ppmw | | 0 | 250 | 0 | 250 |
| Yields, wt. % | | | | | |
| C1-C4 | | 2.6 | 1.9 | 3.0 | 2.1 |
| C5-330 F | | 13.4 | 11.4 | 15.8 | 12.2 |
| 330-730 F | 15 | 29.9 | 31.7 | 26.2 | 30.7 |
| 730 F+ | 85 | 55.0 | 55.0 | 55.0 | 55.0 |
| H2 Consump., SCF/B | | | | | |
| Initial Phase | | 300 | 150 | — | — |
| Line-out | | 150 | 75 | 200 | 100 |

We claim:

1. A method of controlling the operation of a hydrocracking process in which a hydrocarbon fraction is contacted under hydrocracking conditions in the presence of hydrogen with a hydrocracking catalyst during a hydrocracking cycle comprising an initial phase and a second phase following the initial phase, the method comprising carrying out the initial phase of the hydrocracking cycle during which the hydrocracking temperature is being raised at a first rate from 1° to 20° F./day, in the presence of a nitrogen-containing organic compound which is added to the hydrocarbon fraction feed to reduce the hydrogen consumption, followed by carrying out the hydrocracking during a second phase of the hydrocracking cycle during which the temperature of the hydrocracking is raised at a second rate from 0.01° to 0.3° F./day, which is lower than the first rate.

2. A method according to claim 1 in which the nitrogen-containing compound is present in a nitrogen-containing hydrocarbon co-feed which is fed into contact with the hydrocracking catalyst with the hydrocarbon fraction.

3. A method according to claim 1 in which the nitrogen-containing compound is ammonia.

4. A method according to claim 1 in which the hydrocracking catalyst comprises azeolite hydrocracking catalyst.

5. A method according to claim 4 in which the zeolitic hydrocracking catalyst comprises zeolite Y.

6. A method according to claim 4 in which the zeolitic hydrocracking catalyst comprises zeolite USY.

7. A method according to claim 4 in which the zeolite hydrocracking catalyst comprises zeolite beta.

8. A method according to claim 1 in which the first rate at which the hydrocracking temperature is raised is from 1.5° to 3° F./day during the time in which the nitrogenous compound is added.

9. A method according to claim 1 in which the addition of the nitrogen compound is terminated once the hydrocracking catalyst has reached equilibrium.

10. A method according to claim 1 in which the second rate at which the hydrocracking temperature is raised is from 0.01° to 0.3° F/day subsequent to the termination of the addition of the nitrogenous compound.

11. A method according to claim 10 in which the second rate at which the hydrocracking temperature is raised is from 0.03° to 0.1° F./day subsequent to the termination of the addition of the nitrogenous compound.

12. A method according to claim 1 in which the nitrogen compound is added to the hydrocracking zone at a first feed ra.te in the range of from 1 ppmw to 1.0 wt. during the time when the hydrocracking temperature is raised at the first rate and at a second rate, lower than the first rate, during the time when the hydrocracking temperature is raised at the second rate.

13. A method according to claim 12 in which the second rate at which the hydrocracking temperature is raised is from 0.01° to 0.3° F./day.

14. A method according to claim 12 in which the second rate at which the hydrocracking temperature is raised is from 0.03° to 0.1° F./day.

15. A method according to claim 12 in which the nitrogen compound is added to the hydrocracking zone at a first feed rate in the range of from 10 to 500 ppmw during the time when the hydrocracking temperature is raised at the first rate and at a second rate, lower than the first rate, during the time when the hydrocracking temperature is raised at the second rate.

16. A method according to claim 15 in which the second rate at which the hydrocracking temperature is raised is from 0.01° to 0.3° F./day.

17. A method according to claim 15 in which the second rate at which the hydrocracking temperature is raised is from 0.03° to 0.1° F./day.

* * * * *